US007946509B2

(12) United States Patent
Boecking

(10) Patent No.: US 7,946,509 B2
(45) Date of Patent: May 24, 2011

(54) FUEL INJECTOR WITH DIRECT NEEDLE CONTROL AND SERVO VALVE SUPPORT

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 332 days.

(21) Appl. No.: 12/306,060

(22) PCT Filed: Jun. 15, 2007

(86) PCT No.: PCT/EP2007/055939

§ 371 (c)(1),
(2), (4) Date: Dec. 22, 2008

(87) PCT Pub. No.: WO2008/017538

PCT Pub. Date: Feb. 14, 2008

(65) Prior Publication Data

US 2009/0179086 A1 Jul. 16, 2009

(30) Foreign Application Priority Data

Aug. 7, 2006 (DE) ..... 10 2006 036 780

(51) Int. Cl.

| | |
|---|---|
| ***B05B 9/00*** | (2006.01) |
| ***B05B 1/08*** | (2006.01) |
| ***F02M 47/02*** | (2006.01) |
| ***F02M 63/00*** | (2006.01) |
| ***F02M 61/20*** | (2006.01) |
| ***F02M 69/04*** | (2006.01) |
| ***F02M 59/46*** | (2006.01) |
| ***F02M 61/14*** | (2006.01) |

(52) U.S. Cl. ..... 239/125; 239/124; 239/88; 239/91; 239/533.2; 239/533.3; 239/533.9; 239/102.2; 123/445; 123/467; 123/470

(58) Field of Classification Search ..... 239/88–92, 239/533.2, 585.1–585.5, 124–127, 533.9, 239/533.3, 102.1–102.2; 123/445, 467, 470; *B05B 9/00; F02M 47/02*

See application file for complete search history.

(56) References Cited

U.S. PATENT DOCUMENTS 4,565,319 A * 1/1986 Potter ..... 239/88

(Continued)

FOREIGN PATENT DOCUMENTS

DE 10326259 A1 1/2005

(Continued)

*Primary Examiner* — Dinh Q Nguyen
*Assistant Examiner* — Steven M Cernoch
(74) *Attorney, Agent, or Firm* — Ronald E. Greigg

(57) ABSTRACT

The invention relates to an injector for injecting fuel into a combustion chamber of an internal combustion engine. The injector is actuated by an actuator and is connected to a fuel supply line via which fuel is supplied under system pressure. At least one injection opening can be opened or closed off by an injection valve member, which is activated by a control piston via a control chamber to which the control piston and a piston section of the injection valve member are exposed with respective pressure faces. The control piston is a valve piston of a control valve. The pressure face of the control piston and the pressure face of the piston section of the injection valve member are exposed to the control chamber at the same side. The control piston and the piston section of the injection valve member also enclose a further control chamber which is connected to a fuel return line when the control valve is open and to the fuel supply line when the control valve is closed.

20 Claims, 3 Drawing Sheets

U.S. PATENT DOCUMENTS

| | | | | |
|---|---|---|---|---|
| 6,405,941 | B2 * | 6/2002 | Ganser | 239/88 |
| 6,685,105 | B1 * | 2/2004 | Ruehle et al. | 239/102.1 |
| 6,915,789 | B2 * | 7/2005 | Ratner et al. | 123/538 |
| 7,118,046 | B2 * | 10/2006 | Yoshimura et al. | 239/96 |
| 2006/0255184 | A1 | 11/2006 | Kanne et al. | |
| 2007/0152084 | A1 | 7/2007 | Boecking | |

FOREIGN PATENT DOCUMENTS

| | | | |
|---|---|---|---|
| DE | 102004035313 | A1 | 2/2006 |
| EP | 1531258 | A2 | 5/2005 |
| WO | 9637698 | A1 | 11/1996 |
| WO | 2005075811 | A1 | 8/2005 |

* cited by examiner

FUEL INJECTOR WITH DIRECT NEEDLE CONTROL AND SERVO VALVE SUPPORT

CROSS-REFERENCE TO RELATED APPLICATION

This application is a 35 USC 371 application of PCT/EP 2007/055939 filed on Jun. 15, 2007.

BACKGROUND OF THE INVENTION

1. Field of the Invention

The invention is based on an injector for injecting fuel into a combustion chamber of an internal combustion engine.

2. Description of the Prior Art

From German Patent Disclosure DE-A 10 2004 015 744, a fuel injector for injecting fuel into a combustion chamber of an internal combustion engine is known, which has an injector housing that has a fuel inlet which is in communication with a central high-pressure fuel source outside the injector housing and with a pressure chamber inside the injector housing, from which fuel subjected to high pressure is injected as a function of the position of a control valve. The control valve is actuated by means of a piezoelectric actuator. To attain a sufficiently long stroke length for the control valve, a coupling chamber is embodied between the control valve and the piezoelectric actuator. This chamber acts as a hydraulic booster on the valve piston of the control valve.

It is the disadvantage of the fuel injectors known from the prior art, which are actuated by a piezoelectric actuator, that the piezoelectric actuator must be very long in order to attain a sufficiently long travel of the valve piston of the control valve. This leads to a long structural length of the fuel injector.

ADVANTAGES AND SUMMARY OF TILE INVENTION

An injector embodied according to the invention for injecting fuel into a combustion chamber of an internal combustion engine is actuated by means of an actuator and communicates with a fuel inlet by way of which fuel at system pressure is delivered. In the injector, at least one injection opening can be opened or closed by an injection valve member, and the injection valve member is triggered by means of a control piston via a control chamber, to which the control piston and a piston portion of the injection valve member are exposed by their respective pressure faces. The control piston is at the same time a valve piston of a control valve. The valve piston and the piston portion of the injection valve member surround a further control chamber, which when the control valve is open communicates with a fuel return and when the control valve is closed communicates with the fuel inlet. In a first opening phase of the injection valve member, the control piston acts on the injection valve member via the first control chamber, on the principle of direct triggering. A further opening phase of the injection valve member ensues when the control piston acts as a valve piston of a servo valve and triggers the further control chamber. The essence of the invention resides in a combination of direct triggering and servo triggering of the injection valve member; the opening of the injection valve member is effected when the actuator moves the control piston in the direction of the injection openings. The advantage of the injector embodied according to the invention is that as a result of the design of the control piston as a valve piston for the control valve, no additional control valve has to be embodied in the injector to make the operation of the injector possible. For this reason, the structural size of the injector can be reduced. A further advantage of the injector embodied according to the invention is that the stroke of the actuator is boosted in such a way that even a short actuator suffices to generate a sufficiently long stroke of the injection valve member. As a result, it is possible to reduce the structural height of the injector. Furthermore, by the embodiment according to the invention of the injector, the opening speed of the injection valve member at the onset of the opening event is increased, compared to the fuel injectors known from the prior art.

So that the valve piston and the injection valve member will surround the further control chamber, in a first embodiment, an annular portion is embodied on the control piston, and the piston portion of the injection valve member is guided in it. The further control chamber is defined by the injection valve member and the annular portion.

In a second embodiment, the annular portion is embodied on the piston portion of the injection valve member. The control piston is guided in the annular portion, and the further control chamber is defined by the control piston and the annular portion.

To increase the stroke of the control piston still further compared to the actuator stroke, in a further embodiment the actuator is connected to a booster piston, and the booster piston, with an end face, defines a booster chamber, which is defined on the diametrically opposite side by an upper end face of the control piston. The ratio of the strokes of the booster piston and the control piston is proportional to the ratio of the diameters. The greater the diameter of the booster piston compared to the diameter of the end face, defining the control chamber, of the control piston, the longer the stroke of the control piston compared to the stroke of the booster piston.

To enable a sufficiently long stroke of the injection valve member and thus to enable injecting a sufficiently large quantity of fuel into the combustion chamber of the engine, the control chamber that is defined by the injection valve member and the control piston communicates, through a connecting conduit, with a valve chamber that surrounds the control piston. The valve chamber is a valve chamber of the control valve. As soon as the control valve opens, the valve chamber that surrounds the control piston is in communication with a fuel return. As a result, the further control chamber is pressure-relieved when the control valve is open. The injection valve member can travel a longer distance.

In a preferred embodiment, in the connecting conduit, through which the control chamber, which is defined by the injection valve member and the control piston, communicates with the valve chamber, a throttle element is received. By means of the throttle element, the pressure relief and pressure loading of the control chamber are damped. This prevents a return kick on the part of the injection valve member. Moreover, the throttle element acts as a tolerance limiter in the connecting conduit.

To enable filling the further control chamber with fuel at system pressure when the control valve is closed, the valve chamber of the control valve, which chamber communicates with the further control chamber via the connecting conduit, communicates with the fuel inlet by means of a throttle element.

In an embodiment of the fuel injector in which the injection valve member is guided in an annular portion in the control piston, a lower end face on the annular portion defines the control piston, and a shoulder on the piston portion of the injection valve member defines the control chamber. As a result, upon a motion of the control piston into the control chamber, the injection valve member is pushed out of the control chamber. This embodiment has the effect that when current is supplied to the actuator, or in other words the actuator has expanded, the control piston is moved into the control chamber, and as a result of this motion of the control piston the injection valve member moves out of the control chamber and thus lifts from its seat and opens the at least one injection opening. By the ratio of the size of the end face on the annular portion of the control piston to the area of the shoulder that defines the control chamber, the stroke of the injection valve member can be adjusted as a function of the stroke of the control piston. The smaller the area of the shoulder compared to the area of the end face on the annular portion of the control piston, the longer the stroke of the injection valve member in comparison to the stroke of the control piston.

In a further embodiment of the fuel injector, in which the piston portion of the injection valve member has an annular portion in which the control piston is guided, an end face on the annular portion of the piston portion of the injection valve member and a shoulder on the control piston define the control chamber. The function is the same as in the embodiment in which the annular portion is embodied on the control piston, and an injection valve member is guided in that annular portion on the control piston. Here as well, the boosting of the motion of the injection valve member in comparison to the control piston is dependent on the cross-sectional area of the end face of the piston portion of the injection valve member and on the surface area of the shoulder that defines the control chamber. Here as well, the boosting of the motion of the injection valve member in comparison to the control piston is dependent on the cross-sectional area of the end face of the piston portion of the injection valve member and on the surface area of the shoulder that defines the control chamber.

To enable actuating a control piston with the aid of the actuator, preferably a piezoelectric actuator, the control piston in one embodiment is connected directly to the actuator.

To compensate for differences in stroke that can occur from the thermal expansion of the actuator, the actuator is preferably received in a housing that is made of a material whose coefficient of thermal expansion is equivalent to that of the actuator. Because of the virtually identical coefficients of thermal expansion, the housing in which the actuator is received is preferably made of Invar, if the actuator is a piezoelectric actuator.

To compensate for any residual error in the coefficient of thermal expansion that may occur between the actuator and the housing, in a preferred embodiment a compensating element is received between the actuator and the housing. The compensating element is made from aluminum or aluminum alloys, for instance.

The embodiment in which the housing is made from a material whose coefficient of thermal expansion is equivalent to that of the actuator, and in which between the housing and the actuator a compensating element is received by which a residual error of the coefficient of thermal expansion between the actuator and the housing is compensated for, is especially preferable whenever the control piston is connected directly to the actuator. This is necessary in order to assure a clean closure of the control valve. Any residual error that may occur in the stroke for generating the tightness of the control valve can be compensated for electrically, for example. For that purpose, it is possible to operate the actuator in bipolar fashion, for example.

BRIEF DESCRIPTION OF THE DRAWINGS

Exemplary embodiments of the invention are shown in the drawings and described in further detail in the ensuing description, in which.

DESCRIPTION OF THE PREFERRED EMBODIMENTS

Figure 1:
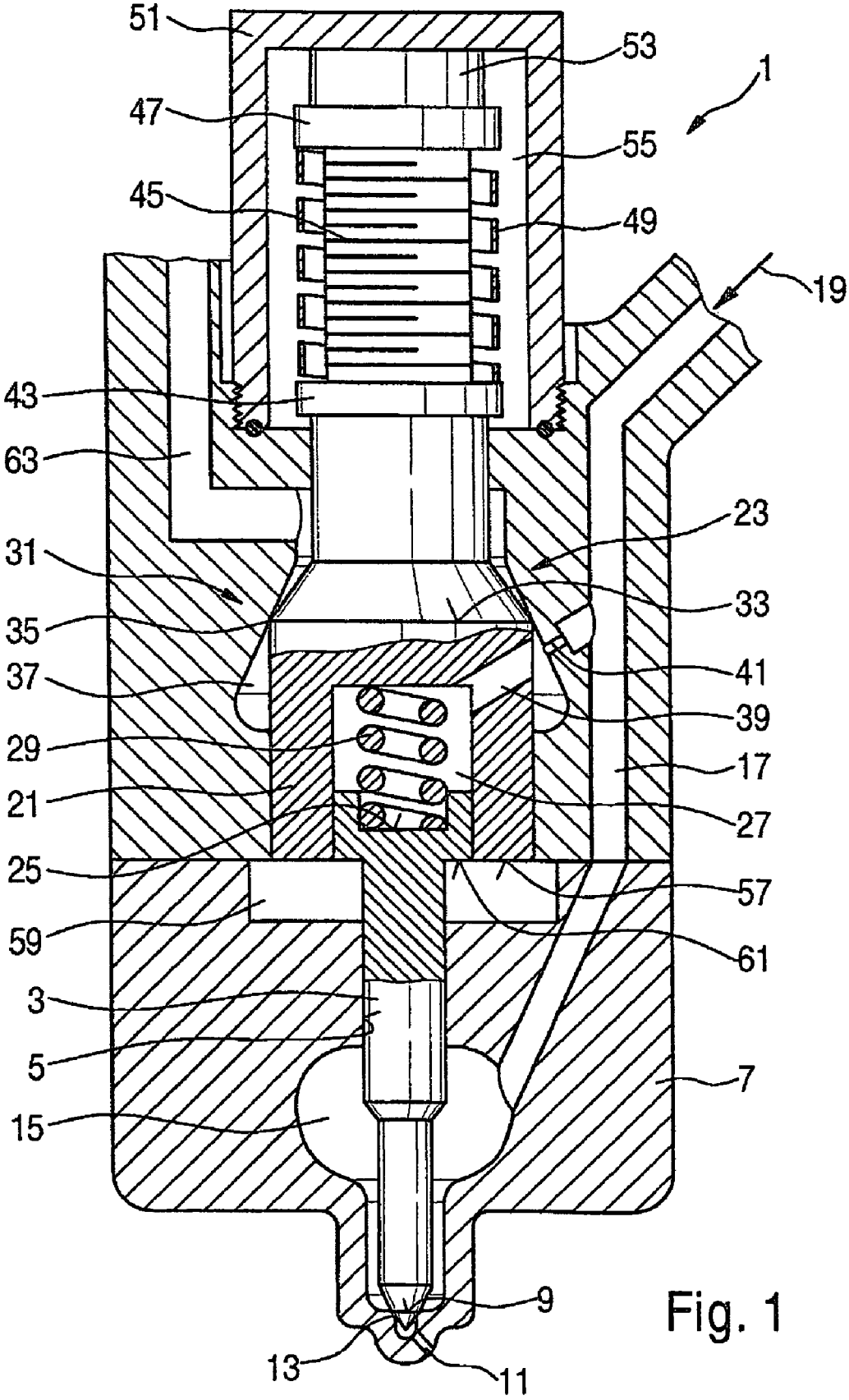
FIG. 1 shows a fuel injector embodied according to the invention, in a first embodiment.

In FIG. 1, a fuel injector embodied according to the invention is shown in a first embodiment.

A fuel injector 1 includes an injection valve member 3, which is guided in a guide 5 in a lower housing part 7. A sealing edge 9 is embodied on the injection valve member 3 and when the injection opening 11 is closed is located in a seat 13. In addition to the embodiment shown here, in which the fuel injector 1 has one injection opening 11, it is also possible for more than one injection opening 11 to be provided.

The injection valve member 3 is surrounded by a nozzle chamber 15. The nozzle chamber 15 communicates via an inflow conduit 17 with a fuel inlet 19. The fuel inlet 19 communicates in turn with a high-pressure reservoir, not shown here, of a common rail system.

On its end remote from the injection opening 11, the injection valve member 3 has a piston portion, which is guided in an annular portion 21 of a control piston 23. An end face 57, which as a pressure face is exposed to a control chamber 59, is embodied on the annular portion 21. A shoulder 61 is embodied on the piston portion of the injection valve member 3; as a further pressure face, it likewise defines the control chamber 59, on the same side as the end face 57 of the annular portion 21. As a result, the injection valve member 3, upon a motion of the control piston 23, is moved in the opposite direction, so that a stroke reversal of the actuator stroke occurs, relative to the stroke of the injection valve member 3. By means of the annular portion 21 and an upper end face 25 of the injection valve member 3, a further control chamber 27 is enclosed. A spring element 29, which is preferably a spiral spring embodied as a compression spring, is received in the further control chamber 27.

The control piston 23 simultaneously functions as a valve piston of a control valve 31. To that end, a sealing edge 33 is embodied on the control piston 23. When the control valve 31 is closed, the sealing edge 33 is located in a seat 35 of the control valve 31. On the side toward the injection valve member 3, the control piston 23 is surrounded by a valve chamber 37.

In the annular portion 21 of the control piston 23, a connecting conduit 39 is embodied, through which the valve chamber 37 communicates with the further control chamber 27. A throttle element 41 also discharges into the valve chamber 37 and causes the valve chamber 37 to communicate with the inflow conduit 17. As a result, when the control valve 31 is closed, the control chamber 27 is filled with fuel at system pressure, via the throttle element 41, the valve chamber 37, and the connecting conduit 39.

A platelike portion 43 is embodied on the control piston 23 and is connected to an actuator 45, preferably to a piezoelectric actuator. Instead of a piezoelectric actuator, any other actuator known to one skilled in the art can be used that expands on being supplied with current and contracts upon determination of the supply of current.

On the side diametrically opposite the control piston 23, the actuator is connected to a disk 47. To achieve the necessary prestressing, the actuator is surrounded by a spring element 49. The spring element 49 is preferably a tubular spring embodied as a tension spring.

To avoid malfunctions that can occur from the thermal expansion of the actuator 45, the actuator 45 is received in a housing 51 that is made of a material that has essentially the same coefficient of thermal expansion as the actuator 45. If the actuator 45 is a piezoelectric actuator, then the housing 51 is preferably made from Invar. To compensate for any residual error that may occur because of the different coefficients of thermal expansion, in the embodiment shown in FIG. 1 a compensating element 53 is received between the disk 47, which is connected to the actuator 45, and the housing 51. The compensating element 53 is made from aluminum, for example.

By means of the housing 51, an actuator chamber 55 is embodied, which in operation of the fuel injector 1 is filled with fuel. As a result, the actuator 45 is bathed by fuel. Because of the good thermal conductivity of the fuel, the heat that is generated by the actuator 45 in operation is transmitted to the housing 51. Thus the fuel with which the actuator 45 is bathed simultaneously serves to cool the actuator 45.

To start the injection event, current is supplied to the actuator 45. As a result, the actuator 45 expands. As a result of the expansion of the actuator 45, the control piston 23 is moved in the direction of the injection valve member 3. As a result of the motion of the control piston 23, the pressure in the control chamber 59 increases. The thus-increasing pressure force acts on the shoulder 61 on the piston portion of the injection valve member 3 and moves the injection valve member 3 in the opposite direction to the actuator stroke and lifts the injection valve member 3 from its seat 13 and as a result opens the at least one injection opening 11. In this opening phase of the injection valve member 3, the control piston 23 acts directly on the injection valve member 3 via the control chamber 59. At the same time, by the motion of the control piston 23, the sealing edge 33 of the control valve 31 lifts from its seat 35 and thus opens a communication from the valve chamber 37 into a fuel return 63. As a result, the pressure in the valve chamber 37 drops to the return pressure. Because of the lowered pressure in the valve chamber 37, fuel flows from out of the further control chamber 27 via the connecting conduit 39 into the valve chamber 37 and from there onward into the fuel return 63. The pressure in the further control chamber 27 decreases. In this further opening phase of the injection valve member 3, the control piston 23 acts as a valve piston of a servo valve and triggers the further control chamber 27. Because of the decreasing pressure in the control chamber 27, the motion of the injection valve member 3 is made easier. Fast opening of the injection valve member 3 with a boosted actuator stroke is thus achieved.

To terminate the injection event again, the supply of current to the actuator 45 is stopped. The actuator 45 contracts and as a result moves the control piston 23 in the direction of the actuator 45. As a result of this motion, the end face 57 lifts out of the control chamber 59 and thus increases the volume of that chamber. The pressure in the control chamber 59 decreases. As a result, a lesser pressure force acts on the shoulders 61 at the injection valve member 3. As soon as the pressure force which acts on the shoulders 61 of the injection valve member 3 is less than the pressure force that acts on the upper end face 25 of the injection valve member 3, the injection valve member 3 moves into its seat 13 and thereby closes the injection opening 11. The motion of the injection valve member 3 is supported by the fact that by the motion of the control piston 23, the sealing edge 33 is put into its seat 35, and thus the control valve 31 is closed. As soon as the control valve 31 is closed, fuel at system pressure can flow out of the inflow conduit 17 into the further control chamber 27, via the throttle element 41, the valve chamber 37, and the connecting conduit 39. The pressure in the further control chamber 27 rises to system pressure. As a result, a further-increased pressure force is exerted on the upper end face 25 of the injection valve member 3. The motion of the injection valve member 3 is accelerated.

So that the control valve 31 will close tightly, so that no fuel can flow out of the valve chamber 37 into the fuel return 63 when the control valve 31 is closed, it is necessary that any changes in length of the actuator that occur as a result of increasing temperature be compensated for. This is done first by making the housing 51 from a material which has approximately the same coefficient of thermal expansion as the actuator 45. Differences in the coefficients of thermal expansion of the actuator 45 and the housing 51 are compensated for by the compensating element 53, for example. Should a residual error in the stroke nevertheless occur, causing the control valve 31 not to close tightly, it is possible to compensate for this error electrically. For that purpose, the actuator is for instance operated in bipolar fashion. However, that requires the use of a bipolar piezoelectric actuator. The advantage of the bipolar piezoelectric actuator is that when the voltage reverses it contracts. It is thus possible, if the control valve 31 does not close because of the thermal expansion of the actuator 45, to apply a negative voltage to the actuator 45 and thus bring about a contraction of the actuator 45. As a result, the control piston 23 is moved farther in the direction of the actuator 45, and the sealing edge 33 is put into its seat 35.

Figure 2:
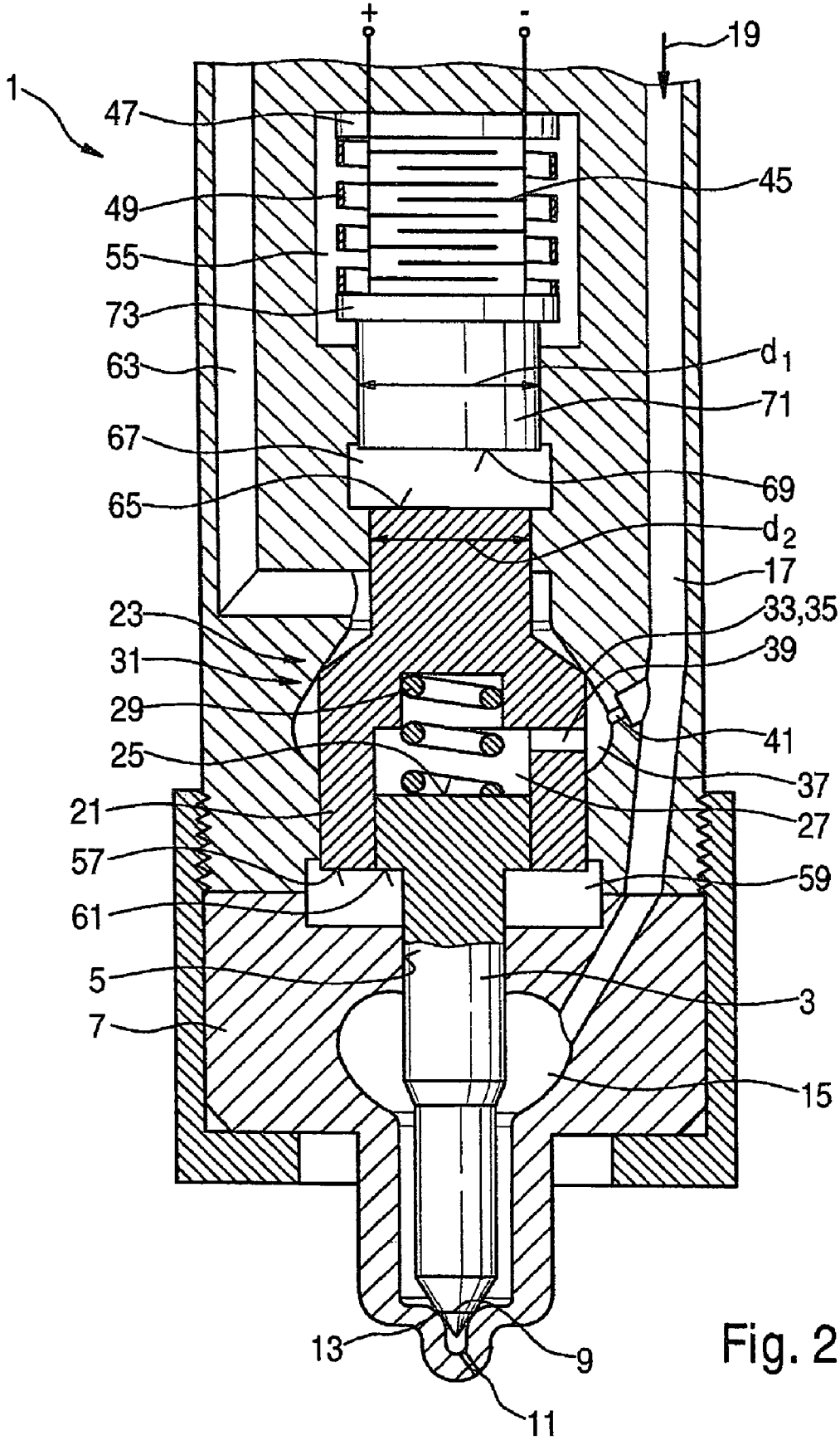
FIG. 2 shows a fuel injector embodied according to the invention, in a second embodiment.

In FIG. 2, a fuel injector embodied according to the invention is shown in a second embodiment.

The fuel injector shown in FIG. 2 differs from the fuel injector shown in FIG. 1 in that the control piston 23 is not connected to the actuator 45, but instead, with an upper end face 65, defines a booster chamber 67. On the side diametrically opposite the upper end face 65, the booster chamber 67 is defined by an end face 69 of a booster piston 71. A platelike extension 73, which is connected to the actuator 45, is embodied on the booster piston 71.

Since the control piston 23 is not connected directly to the actuator 45 and instead, a hydraulic transmission of the motion of the actuator 45 to the control piston 23 is effected, in the embodiment shown in FIG. 2, there is no need to compensate for a stroke error caused by thermal expansion by providing a housing 51 made of material whose coefficient of thermal expansion is equivalent to that of the actuator 45. Compensating for the stroke error is done by means of the booster chamber 67. Simultaneously, by means of the booster chamber 67, it is possible to boost the stroke of the actuator 45 to the stroke of the control piston 23. The boosting ratio is dependent on the diameter $d_1$ of the booster piston 71 and the diameter $d_2$ of the control piston 23. As soon as the diameter $d_1$ of the booster piston 71 is greater than the diameter $d_2$ of the upper end face 65 of the control piston 23, the stroke of the control piston 23 is longer than the stroke of the booster piston 71. As a result, it is possible to reduce the structural height of the actuator 45, since only a shorter stroke of the actuator 45 is required.

The operation of the fuel injector having the embodiment shown in FIG. 2 differs from the embodiment shown in FIG. 1 in that when current is supplied to the actuator 45, the actuator 45 expands, and as a result, the booster piston 71 is moved with the end face 69 into the booster chamber 67. As a result, the volume in the booster chamber 67 decreases. The pressure in the booster chamber 67 increases. Because of the increasing pressure, an increased pressure force is exerted on the upper end face 65 of the control piston 23. Because of this increased pressure force on the upper end face 65 of the control piston 23, the control piston 23 is moved in the direction of the injection valve member 3. As a result of the motion of the control piston 23, the sealing edge 33 is lifted from its seat 35, and the control valve 31 opens. Simultaneously, the end face 57 of the annular portion 21 is moved into the control chamber 59, and as a result the volume in the second control chamber 59 decreases and accordingly a greater pressure force is exerted on the shoulders 61 on the injection valve member 3. The injection valve member 3 is lifted from its seat. As a result of the opening of the control valve, the pressure in the further control chamber 27 is reduced, since fuel can flow from the control chamber 27 into the fuel return 63, via the connecting conduit 39 and the valve chamber 37. Because of the decreasing pressure in the control chamber 27, rapid opening of the injection valve member 3 and thus rapid opening of the at least one injection opening 11 are possible.

To terminate an injection event, the supply of current to the actuator 45 is withdrawn. The actuator 45 contracts. As a result, the booster piston 71 is moved with the end face 69 out of the booster chamber 67. The volume in the booster chamber 67 increases. As a result, the pressure in the booster chamber 67 decreases, and a lesser pressure force acts on the upper end face 65 of the control piston 23. As a result, the control piston 23 is moved into the booster chamber 67, in the direction of the booster piston 71. This motion of the control piston 23 causes the sealing edge 33 to be put into the seat 35, and thus the control valve 31 closes off the communication from the valve chamber 37 into the fuel return 63. At the same time, by the motion of the control piston 23, the end face 57 of the annular portion 21 is lifted out of the second control chamber 59, and thus the volume in the control chamber 59 increases. As a result, the pressure force that is exerted on the shoulders 61 of the injection valve member 3 decreases. Since because of the closed control valve 31 fuel at system pressure flows into the further control chamber 27, via the internal throttle restriction 41, the valve chamber 37, and the connecting conduit 39, and since as a result the pressure in the further control chamber 27 increases, an increased pressure force acts on the upper end face 25 of the injection valve member 3. The injection valve member 3 is put with the sealing edge into its seat 13 and thus closes the at least one injection opening 11. The injection event is ended. As a result of the pressure buildup in the further control chamber 27, the closing motion of the injection valve member 3 is increased.

Figure 3:
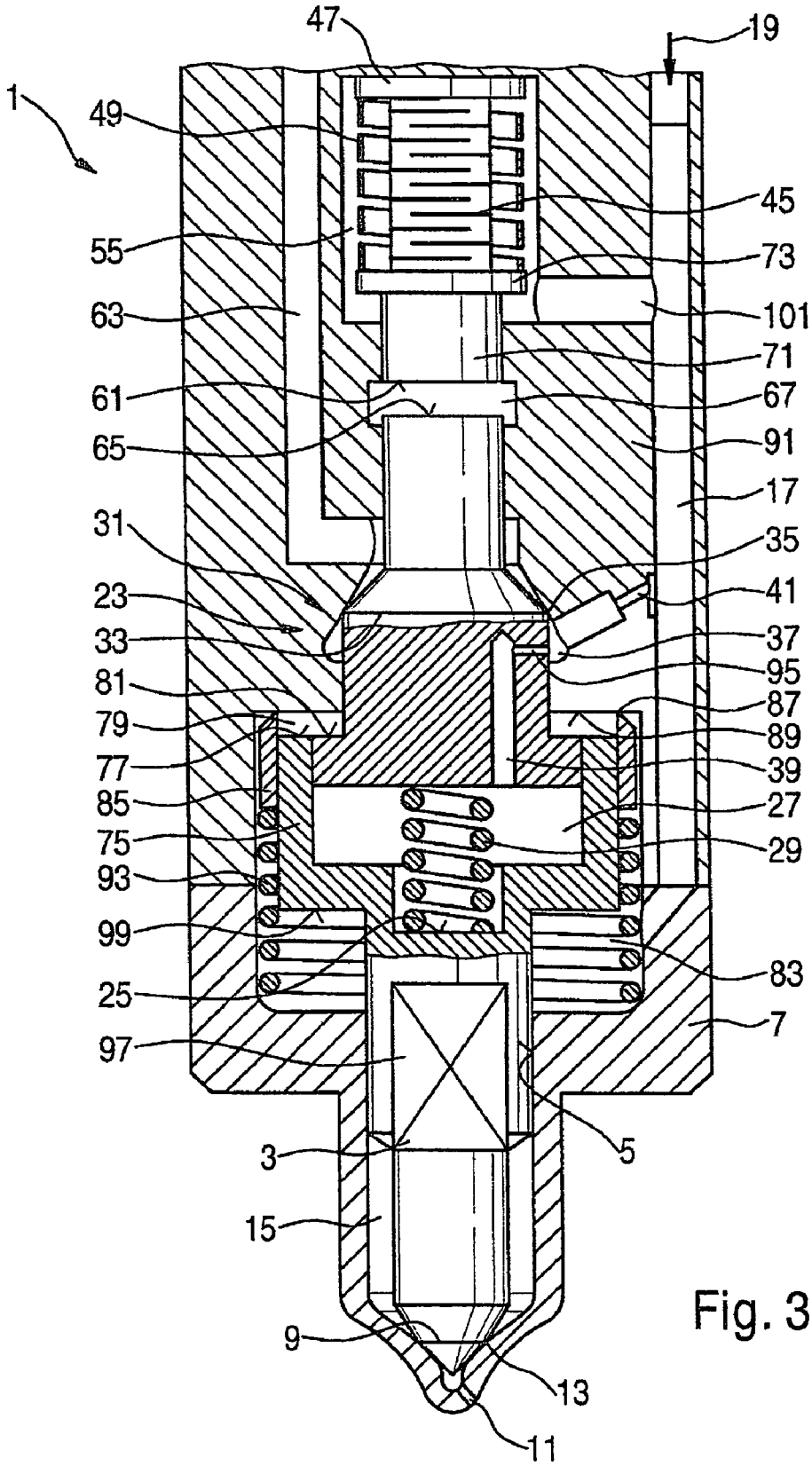
FIG. 3 shows a fuel injector embodied according to the invention, in a third embodiment.

FIG. 3 shows a fuel injector embodied according to the invention in a third embodiment.

Unlike the fuel injector shown in FIG. 2, in the fuel injector shown in FIG. 3, an annular portion 75 is embodied on the piston portion of the injection valve member 3, in which annular portion the control piston 23 is guided. The annular portion 75 and the control piston 23 surround the further control chamber 27. With an end face 77, the annular portion 75 on the piston portion of the injection valve member 3 defines a control chamber 79. A shoulder 81 is also embodied on the control piston 23; it defines the control chamber 79 on the same side as the end face 77 of the annular portion 75. Relative to a third control chamber 83, which communicates with the fuel inlet 19 via the inflow conduit 17, the second control chamber 79 is defined by a ring element 85, which surrounds the annular portion 75 on the injection valve member 3. For that purpose, the ring element 85 is placed with a biting edge 87 against a shoulder 89 on the middle housing part 91. The force required for this is exerted by a spring element 93, which is braced on one end against the ring element 85 and on the other against the lower housing part 7. The spring element 93 is preferably a spiral spring embodied as a compression spring.

To damp pressure fluctuations that may occur in the control chamber 27, a throttle element 95 is embodied in the connecting conduit 39.

Besides the embodiment shown in FIG. 3, in the embodiments shown in FIGS. 1 and 2 it is also possible to provide a throttle element in the connecting conduit 39 by which the further control chamber 27 communicates with the valve chamber 37.

So that fuel at system pressure can flow out of the third control chamber 83 into the nozzle chamber 15, in the embodiment shown in FIG. 3 at least one flat face 97 is embodied in the region'of the guide 5 on the injection valve member 3. The fuel at system pressure can then flow from the fuel inlet 19 via the inflow conduit 17 into the third control chamber 83 first and from there along the flat face 97 into the nozzle chamber 15.

To start the injection event, in the fuel injector shown in FIG. 3 as well, the actuator 45 is supplied with current. As a result, the actuator 45 expands. The booster piston 71 connected to the actuator 45 is moved in the direction of the booster chamber 67. As a result, the volume in the booster chamber 67 decreases. The pressure in the booster chamber 67 rises. Thus an increased pressure force acts on the upper end face 65 of the control piston 23. The control piston 23 is moved in the direction of the injection valve member 3. As a result of the motion of the control piston 23, the sealing edge 33 lifts from its seat 35. A communication from the further control chamber 27, via the connecting conduit 39 and the throttle element 95, to the valve chamber 37 and from there into the fuel return 63, is opened. The pressure in the further control chamber 27 decreases. Simultaneously, by the motion of the control piston 23, the volume in the control chamber 79 is increased, since the shoulder 81 is moved in the direction of the injection valve member. As a result, the pressure in the control chamber 79 decreases. A lesser pressure force acts on the end face 77 of the annular portion 75 on the piston portion of the injection valve member 3. As a result of the pressure force in the third control chamber 83, which acts on a second shoulder 99 on the injection valve member 3, the injection valve member is lifted from its seat 13 and opens the at least one injection opening.

To terminate the injection event, the supply of current to the actuator 45 is stopped again. The actuator 45 contracts. As a result, the booster piston 71 is moved in the direction of the actuator 45. This causes the volume in the booster chamber 67 to increase. A lesser pressure force acts on the upper end face 65 of the control piston 23, and as a result, the control piston 23 is moved in the direction of the booster chamber 67. The sealing edge 33 is returned to its seat 35 and thus closes the control valve 31. Via the internal throttle restriction, fuel at system pressure flows out of the inflow conduit into the valve chamber 37 and from there, via the throttle element 95 and the connecting conduit 39, into the further control chamber 27. The pressure in the control chamber 27 rises. Simultaneously, by the motion of the control piston 23, the shoulder 81 on the control piston 23 moves into the control chamber 79. The volume in the control chamber 79 decreases. As a result, an increased pressure force acts on the end face 77 on the annular portion 75 of the piston portion of the injection valve member 3. As a result of the pressure forces acting on the injection valve member 3, this valve member is moved in the direction of the injection opening, until with the sealing edge 9 it is in the seat 13. The injection opening 11 is closed, and the injection event is ended.

In the embodiment shown in FIG. 3, the actuator chamber 55 communicates with the inflow conduit 17 via a conduit 101. As a result, fuel at system pressure is located in the actuator chamber 55. This fuel serves to dissipate the heat, which occurs in the operation of the actuator, to the housing, since the heat transfer coefficient of the fuel is substantially greater than the heat transfer coefficient of a gas.

The foregoing relates to the preferred exemplary embodiments of the invention, it being understood that other variants and embodiments thereof are possible within the spirit and scope of the invention, the latter being defined by the appended claims.

The invention claimed is:

1. An injector for injecting fuel into a combustion chamber of an internal combustion engine, comprising:

an actuator actuating the injector;

a fuel inlet communicating with the injector and delivering fuel at system pressure;

at least one injection opening being opened or closed by an injection valve member; and a control piston triggering the injection valve member via a control chamber, to which a respective pressure face of the control piston and of a piston portion of the injection valve member are each exposed, wherein the control piston is a valve piston of a control valve, the respective pressure face of the control piston and of the piston portion of the injection valve member define the control chamber on a same side, and the control piston and the piston portion of the injection valve member surround a further control chamber, which when the control valve is open the further control chamber communicates with a fuel return and when the control valve is closed the further control chamber communicates with the fuel inlet.

2. The injector as defined by claim 1, further comprising an annular portion of the control piston, in which the piston portion of the injection valve member is guided, the further control chamber being defined by the piston portion of the injection valve member and by the annular portion of the control piston.

3. The injector as defined by claim 2, wherein the pressure face of the control piston is formed by a lower end face on the annular portion of the control piston, and the pressure face of the piston portion of the injection valve member is formed by a shoulder.

4. The injector as defined by claim 1, wherein the further control chamber, which is defined by the injection valve member and the control piston, communicates through a connecting conduit with a valve chamber that surrounds the control piston.

5. The injector as defined by claim 2, wherein the further control chamber, which is defined by the injection valve member and the control piston, communicates through a connecting conduit with a valve chamber that surrounds the control piston.

6. The injector as defined by claim 3, wherein the further control chamber, which is defined by the injection valve member and the control piston, communicates through a connecting conduit with a valve chamber that surrounds the control piston.

7. The injector as defined by claim 4, wherein in the connecting conduit, through which the further control chamber communicates with the valve chamber, a throttle element is received.

8. The injector as defined by claim 5, wherein in the connecting conduit, through which the further control chamber communicates with the valve chamber, a throttle element is received.

9. The injector as defined by claim 6, wherein in the connecting conduit, through which the further control chamber communicates with the valve chamber, a throttle element is received.

10. The injector as defined by claim 4, wherein the valve chamber communicates with the fuel inlet by means of a throttle element.

11. The injector as defined by claim 7, wherein the valve chamber communicates with the fuel inlet by means of a throttle element.

12. The injector as defined by claim 1, wherein on the piston portion of the injection valve member, an annular portion is embodied, in which the control piston is guided, and the further control chamber is defined by the control piston and the annular portion.

13. The injector as defined by claim 12, wherein an end face on the annular portion of the piston portion of the injection valve member and a shoulder on the control piston define the control chamber on the same side.

14. The injector as defined by claim 1, wherein the actuator is connected to the control piston.

15. The injector as defined by claim 4, wherein the actuator is connected to the control piston.

16. The injector as defined by claim 1, wherein the actuator is connected to a booster piston, and the booster piston has an end face that defines a booster chamber, which is defined on a diametrically opposite side thereof by an upper end face of the control piston.

17. The injector as defined by claim 4, wherein the actuator is connected to a booster piston, and the booster piston has an end face that defines a booster chamber, which is defined on a diametrically opposite side thereof by an upper end face of the control piston.

18. The injector as defined by claim 1, wherein between the actuator and a housing, a compensating element is received, by which a residual error in a coefficient of thermal expansion between the actuator and the housing is compensated for.

19. The injector as defined by claim 4, wherein between the actuator and a housing, a compensating element is received, by which a residual error in a coefficient of thermal expansion between the actuator and the housing is compensated for.

20. The injector as defined by claim 1, wherein the actuator is received in a housing, which is made from a material whose coefficient of thermal expansion is equivalent to that of the actuator.

* * * * *